United States Patent [19]

Kohashi et al.

[11] Patent Number: 4,586,194

[45] Date of Patent: Apr. 29, 1986

[54] EARPHONE CHARACTERISTIC MEASURING DEVICE

[75] Inventors: Makoto Kohashi, Kanagawa; Tanetoshi Miura, Kokubunji; Kaoru Okabe, Kunitachi; Haruo Hamada, Mitaka, all of Japan

[73] Assignee: Hitachi, Ltd., Tokyo, Japan

[21] Appl. No.: 576,476

[22] Filed: Feb. 2, 1984

[30] Foreign Application Priority Data

Mar. 9, 1983 [JP] Japan ..... 58-37335

[51] Int. Cl.[4] ..... H04R 29/00

[52] U.S. Cl. ..... 381/60; 73/585

[58] Field of Search ..... 381/58, 59, 60, 68; 73/585, 589, 591

[56] References Cited

U.S. PATENT DOCUMENTS

| | | | |
|---|---|---|---|
| 4,079,198 | 3/1978 | Bennett | 73/585 |
| 4,251,686 | 2/1981 | Sokolich | 73/585 |
| 4,289,143 | 9/1981 | Canavesio et al. | 73/585 |
| 4,425,481 | 1/1984 | Mansgold et al. | 381/68 |
| 4,459,996 | 7/1984 | Teele | 73/585 |
| 4,471,171 | 9/1984 | Köpke et al. | 381/68 |

OTHER PUBLICATIONS

"Head and Torso Simulator with Simplified Artificial Ear and Its Application to Simulated in Situ Measurement of Hearing Aid," 11th International Congress of Acoustics in Paris, 1983.

*Primary Examiner*—Forester W. Isen

*Attorney, Agent, or Firm*—Antonelli, Terry & Wands

[57] ABSTRACT

An earphone characteristic measuring device comprises an acoustic coupler having an acoustic tube simulated to an external auditory canal in which an earphone under measurement is to be inserted and an acoustic tube of a smaller diameter having an acoustic impedance of approximately 320 ohms connected to an end of the first acoustic tube, a sound source for emitting an impulse sound to the acoustic coupler, a microphone mounted at the end of the first acoustic tube for picking up sound pressure information and a characteristic calculation circuit for transforming an earphone characteristic of the acoustic coupler to an earphone characteristic of a real ear based on an input impedance of the acoustic coupler viewed from an end of the earphone inserted in the acoustic coupler and an input impedance of the real ear represented by a sum of an eardrum impedance of the real ear and an external auditory canal volume of the real ear, stored in a memory in response to the sound pressure information from the microphone. The use of the acoustic coupler of a simple structure facilitates the measurement of a vent characteristic of the earphone and an insertion gain and improves reliability of the measurement.

17 Claims, 14 Drawing Figures

FLOW CHART FOR MEASURING VENT CHARACTERISTIC USING C-TYPE COUPLER

FLOW CHART FOR MEASURING INSERTION GAIN

EARPHONE CHARACTERISTIC MEASURING DEVICE

The present invention relates to an instrument for measuring an earphone such as a hearing aid.

When the hearing aid is applied to an individual person having a difficulty in hearing, a small hole called a vent is usually formed in an earmold to adjust a characteristic of the hearing aid.

As a parameter to represent the characteristic of the vented earphone, a ratio of sound pressures in an external auditory canal with the vent and without the vent is called a vent characteristic. In the past, in order to measure the vent characteristic, a so-called 2 cc coupler shown in FIG. 1*a* having a microphone 2 mounted behind a cavity 1 having an internal volume of 2 cc in which a hearing aid under measurement is to be mounted, or a Zwislocki coupler shown in FIG. 1*b* housing an acoustic impedance element 4 corresponding to an eardrum impedance of a real ear or normal ear and a microphone 2 arranged behind an acoustic duct (dummy external auditory canal) 3, has been used.

However, since the prior art 2 cc coupler shown in FIG. 1*a* for measuring the earphone characteristic does not simulate the acoustic impedance of the eardrum and the external auditory canal of the real ear, a vent characteristic shown in FIG. 2 curve a measured by the 2 cc coupler is largely different from a vent characteristic of the real ear as shown in FIG. 2 curve c measured by a phobe tube microphone, and an experience of an expert is needed to analyze the measurement result. Thus, the 2 cc coupler is not suitable for practical use.

The Zwislocki coupler shown in FIG. 1*b* has the acoustic impedance element 4 which comprises a plurality of cavities 41, narrow tubes or conduits 42 having a diameter of 0.2–0.7 mm to connect the cavities 41 to the dummy external auditory canal 3 and impedance materials 43 filled in the cavities 41, in order to exactly simulate the impedance of the eardrum and the external auditory canal of the real ear. Accordingly, a vent characteristic shown in FIG. 2 curve b measured by the Zwislocki coupler coincides with the vent characteristic of the real ear shown in FIG. 2 curve c, without practical problem. However, the Zwislocki coupler is complex in structure and if dust particles in the air deposit to the narrow tubes 42 or the impedance materials 43, the impedance changes and the performance is instable. When the Zwislocki coupler is used, it must be cleared and adjusted and a maintenance work is troublesome. It is expensive and inconvenient to use.

It is an object of the present invention to provide an earphone characteristic measuring device which needs no acoustic impedance element to simulate an eardrum of a real ear, which is complex in structure, and uses an acoustic coupler as an artificial ear having a simple structure and a stable characteristic and yet permits the obtaining of the same earphone characteristic such as a vent characteristic or an insertion gain as that of the real ear.

It is another object of the present invention to provide a measuring device which allows an unexperienced person to readily measure an earphone characteristic even in a place other than in an anechoic room.

The present invention is based on a finding of a specific relationship between an earphone characteristic such as a vent characteristic in a real ear and an earphone characteristic in a coupler or artificial ear. In order to transform the characteristic based on the above relationship, a memory for storing an impedance value of the realear and an impedance value of the coupler which simulates the real ear, and a processor for processing the content of the memory and a sound pressure output from a microphone picked up in the coupler for the earphone under measurement are provided so that the earphone characteristic of the real ear can be readily and reliably obtained from the earphone characteristic of the coupler.

The other objects, features and advantages of the present invention will be apparent from the following detailed description of the invention taken in conjunction with the accompanying drawings, in which:

FIGS. 1*a* and 1*b* sectional views showing the structure of couplers in prior art earphone characteristic measuring devices;

FIG. 2 shows a vent characteristic measured by the prior art coupler and a vent characteristic of a real ear;

FIGS. 3*a*–3*d* illustrate measurement of vent characteristics to explain a principle of the present invention, in which FIG. 3*a* shows a coupler having a non-vented earphone inserted therein, FIG. 3*b* shows an electrical equivalent circuit of FIG. 3*a*, FIG. 3*c* shows a coupler having a vented earphone inserted therein, and FIG. 3*d* shows an electrical equivalent circuit of FIG. 3*c*;

FIG. 4*a* shows a configuration of one embodiment of the earphone characteristic measuring device of the present invention;

FIG. 4*b* shows an acoustic coupler which is referred to as C-type coupler hereinafter and a dummy head used in the present invention;

Figure 3A:
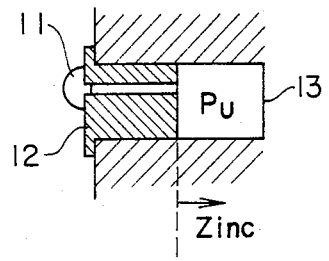
Figure 3B:
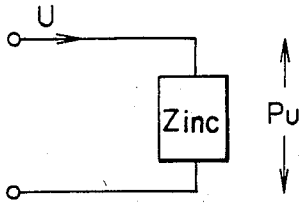
Figure 3C:
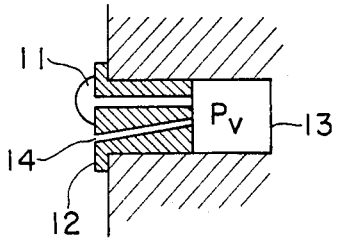
Figure 3D:
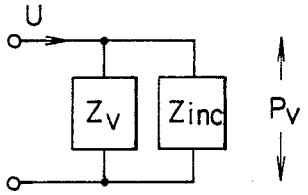

A principle of measurement of a vent characteristic of a vented earphone is first explained. In FIG. 3*a*, an earphone 11 and an earmold 12 are inserted in a coupler 13. An input impedance of the coupler viewed from an end of the earmold 12 is represented by $Z_{inc}$, and a sound pressure in the coupler 13 is represented by $P_u$. FIG. 3*b* is an electrical equivalent circuit of FIG. 3*a* in which U denotes a volume velocity of a sound wave generated by the earphone 11. On the other hand, FIG. 3*c* shows an earmold 12 having a vent 14. An internal sound pressure of the coupler 13 is represented by $P_v$. FIG. 3*d* is an electrical equivalent circuit of FIG. 3*c* in which $Z_v$ denotes an acoustic impedance of the vent 14.

Since the earphone 11 usually has a constant volume velocity U, a vent characteristic $H_c$ measured by the coupler 13 is expressed as follows, from the equivalent circuits of FIGS. 3*b* and 3*d*.

$$H_c = \frac{P_V}{P_U} = \frac{\dfrac{Z_v \cdot Z_{inc}}{Z_v + Z_{inc}} \cdot U}{Z_{inc} \cdot U} = \frac{Z_v}{Z_v + Z_{inc}} \tag{1}$$

Similarly, a vent characteristic $H_r$ of a real ear is expressed as follows by using similar equivalent circuits.

$$H_r = \frac{\hat{P}_v}{P_U} = \frac{\frac{Z_v \cdot Z_{inr}}{Z_v + Z_{inr}} \cdot U}{Z_{inr} \cdot U} = \frac{Z_v}{Z_v + Z_{inr}} \quad (2)$$

where $\hat{P}_V$ is a sound pressure in an external auditory canal of the real ear with vent, $\hat{P}_U$ is a sound pressure in the external auditory canal of the real ear without vent and $Z_{inr}$ is an input impedance of the real ear predetermined by the sum of an external auditory canal volume of the real ear and an eardrum impedance of the real ear. From the equations (1) and (2), a relation between $H_c$ and $H_r$ is expressed as $$H_r = \frac{Z_{inc} \cdot H_c}{Z_{inc} \cdot H_c + (1 - H_c) \cdot Z_{inr}} \quad (3)$$

The equation (3) shows that the vent characteristic $H_r$ of the real ear can be obtained from the vent characteristic $H_c$ measured by the coupler 13, the input impedance $Z_{inc}$ of the coupler 13 and the input impedance $Z_{inr}$ of the real ear. The input impedance $Z_{inc}$ of the coupler 13 need not be equal to the input impedance $Z_{inr}$ of the real ear.

Some of the inventors of the present invention, Okabe, Hamada and Miura reported results of measurement of the earphone characteristic of a simplified artificial ear terminated by a resistor and mounted on a Head and Torso Simulator, and a method for measuring a vent response characteristic, in an article entitled "Head and Torso Simulator (SAMRAI) with Simplified Artificial Ear and Its Application to Simulated In Situ Measurement of Hearing Aid", lle ICA, 1983 (11th International Congress of Acoustics in Paris, 1983).

Figure 4A:
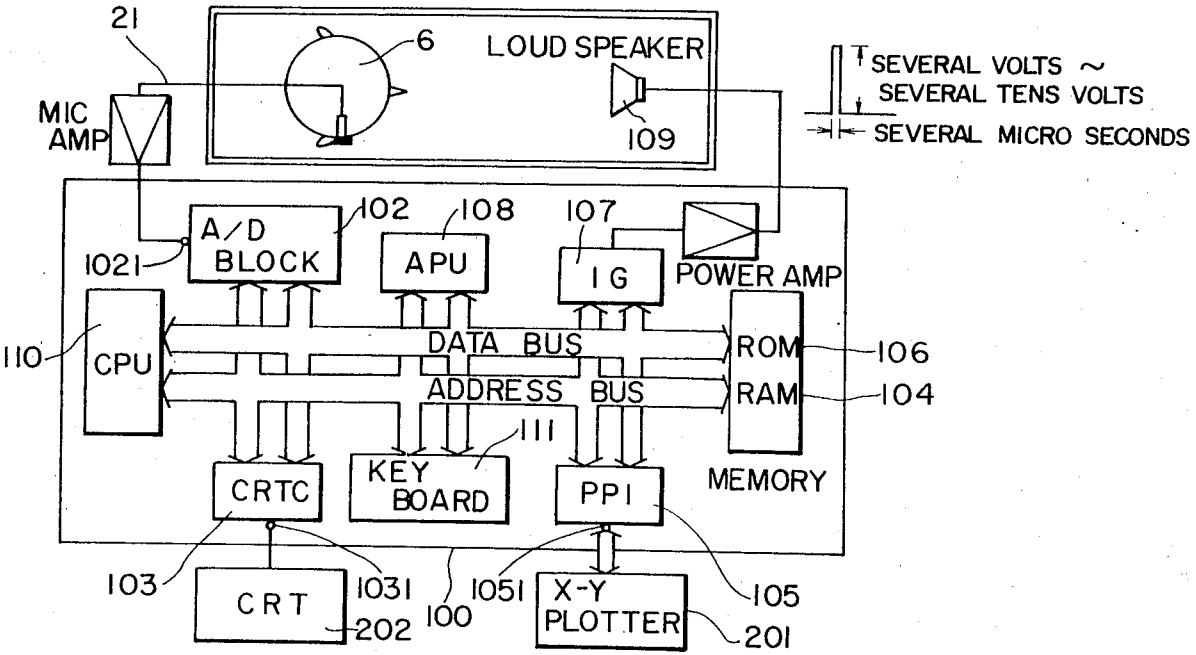
Figure 4B:
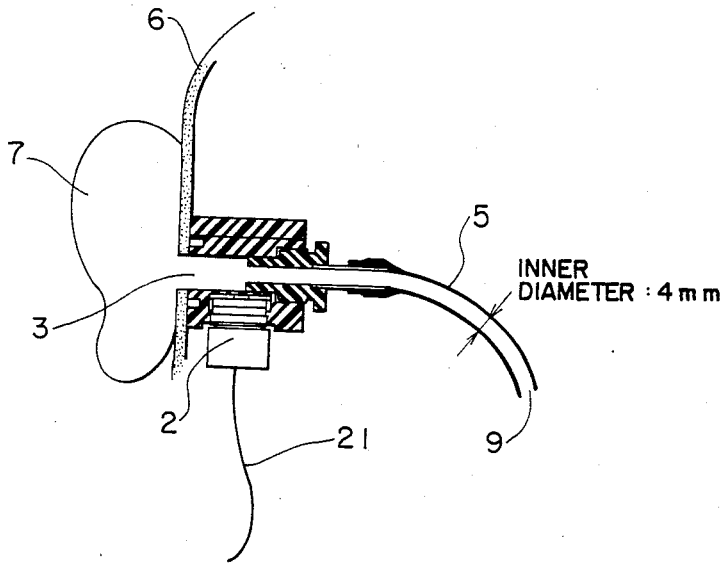

The preferred embodiments of the present invention will now be described with reference to the drawings. FIGS. 4*a* and 4*b* show a configuration and a structure of one embodiment of the earphone characteristic measuring device which is applied to the measurement of hearing aid characteristics. An acoustic tube 3 corresponding to an external auditory canal is formed in a dummy head 6, and it extends from a pinna 7 formed on an outer periphery of the dummy head 6, and an acoustic tube 5 having a smaller diameter than an acoustic tube 3 is connected in series to the acoustic tube 3 at an end thereof in order to form a terminating resistance. A microphone 2 is arranged on a side of the acoustic tube 3. An end 9 of the acoustic tube 3 which is not connected to the acoustic tube 3 is open-ended.

The inner diameter of the acoustic tube 3 is 7–8 mm, the length thereof is 20–25 mm. The inner diameter of the acoustic tube 5 is 3–5 mm and the length thereof is approximately 4 m so as to provide a resistance termination for the acoustic tube 3. The acoustic tube 5 is a vinyl tube, which is wound in a spiral shape and accommodated in the dummy head 6.

Such an artificial ear is disclosed in Japanese Patent Application No. 57-81401 (Japanese Patent Laid-Open No. 58-198338 dated Nov. 18, 1983) assigned to the present assignee. Since this artificial ear simulates the acoustic impedance of the real ear by a simplified method, the vent characteristic thereof does not correspond to that of the real ear.

An output of the microphone 2 of the artificial ear ear is supplied to a measurement instrument 100 through a cord 21.

In the measurement instrument 100, numerals 102, 103 and 105 denote input/output interfaces. Numeral 107 denotes an electrical impluse generator (IG) which is used to drive a loudspeaker 109. Numeral 111 denotes a keyboard. Numeral 104 denotes a random access memory (RAM) which may be Hitachi IC HM6116. Numeral 106 denotes a read-only memory (ROM) which may be Intel IC D2716. Numeral 108 denotes an arithmetic processing unit (APU) which may be Advanced Micro Device IC AM9511A-4. Numeral 110 denotes a central processing unit (CPU) which may be Sharp IC LH0080. A data bus for transferring data from the CPU 110 to the respective units and an address bus for controlling the operations of the respective units are connected.

The operations of the respective units are now explained. The microphone 2 picks up sound pressures (sound pressure $P_U$ when the earmold of the earphone is not vented and sound pressure $P_V$ when it is vented) created in dummy external auditory canal of the artificial ear. The output of the microphone 2 is supplied to an input port 1021 of the input interface 102 including an A/D converter of the measurement instrument 100 through the cord 21, and stored in the RAM 104. This data is transformed to a frequency domain data by a fast Fourier transform (FFT) program stored in the ROM 106. A multiplication and an addition are carried out by the APU 108. This procedure is carried out twice, one for the sound pressure $P_U$ for the non-vented earmold of the earphone and one for the sound pressure $P_V$ for the vented earmold.

In order to determine the vent characteristic $H_c$ of the artificial ear, the ratio $H_c(=P_V/P_U)$ of the two frequency domain data ($P_U$ and $P_V$) stored in the RAM 104 is calculated by the APU 108 in accordance with a program for executing the above equation (1), stored in the ROM 106, and a result of the calculation is stored in the RAM 104.

Then, in order to calculate the vent characteristic $H_r$ of the real ear, the vent characteristic $H_C$ stored in the RAM 104 is transformed to the vent characteristic $H_r$ of the real ear by using a program for executing the equation (3) stored in the ROM 106, the input impedance $Z_{inc}$ of the artificial ear obtained by using an acoustic tube model having an acoustic impedance at the end of the acoustic tube end of 320 Ω. The APU 108 is used for the above calculation. The input impedance $Z_{inr}$ of the real ear is determined from the eardrum impedance data by E. A. G. Shaw "The external ear." in Handbook of Sensor Physiology, Springer-Verlag, 1974, using an acoustic pipe model. The resulting data $H_r$ is supplied to an external display device through output ports 1031 and 1051 of the output interfaces 103 and 105 including a CRT controller and a programmable peripheral interface, respectively. The external display device may be a plotter 201 or a CRT display 202.

In the present embodiment, a signal averaging technique in which an S/N (signal to noise) ratio is improved by measuring the impulse response a number of times may be used. The electric impulse generator (IG) 107 is controlled by the CPU 110 to change a period of the electrical impulses in a predetermined irregular pattern to eliminate a periodic noise such as noise from an air conditioner.

The present embodiment has an additional function of truncating a reflection wave in the measured impulse response. Thus, by arranging sound absorbing material such as glass wool on walls and floors, the device of the present embodiment can be used in a place other than in an anechoic room.

Figure 1A:
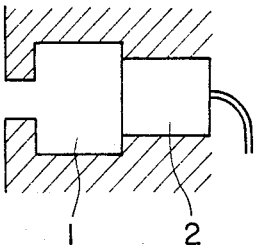
FIG. 1a PRIOR ART
Figure 2:
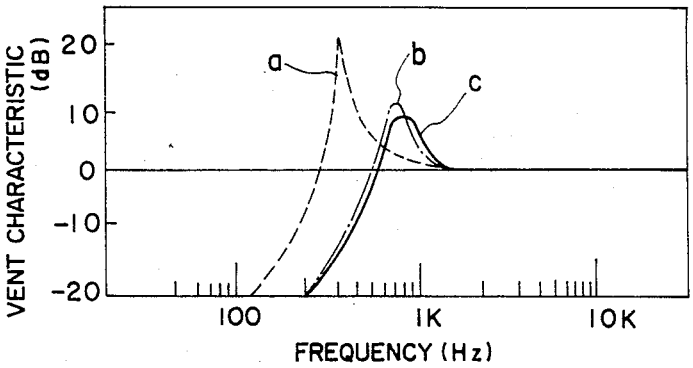
FIG. 2 PRIOR ART
Figure 6:
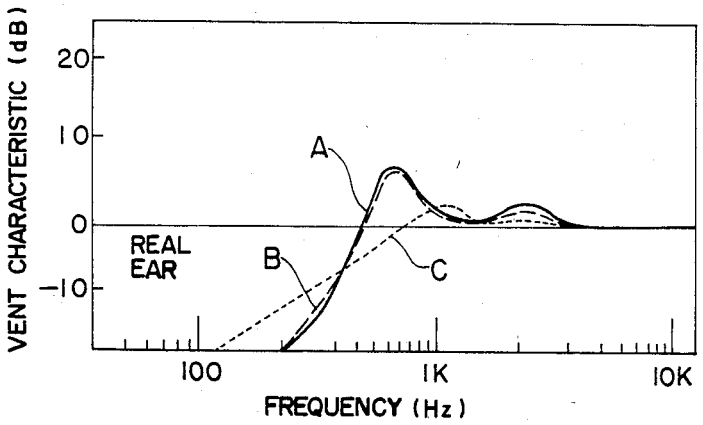
FIG. 6 shows a comparison between a vent characteristic measured by the embodiment and a vent characteristic of a real ear.
Figure 5:
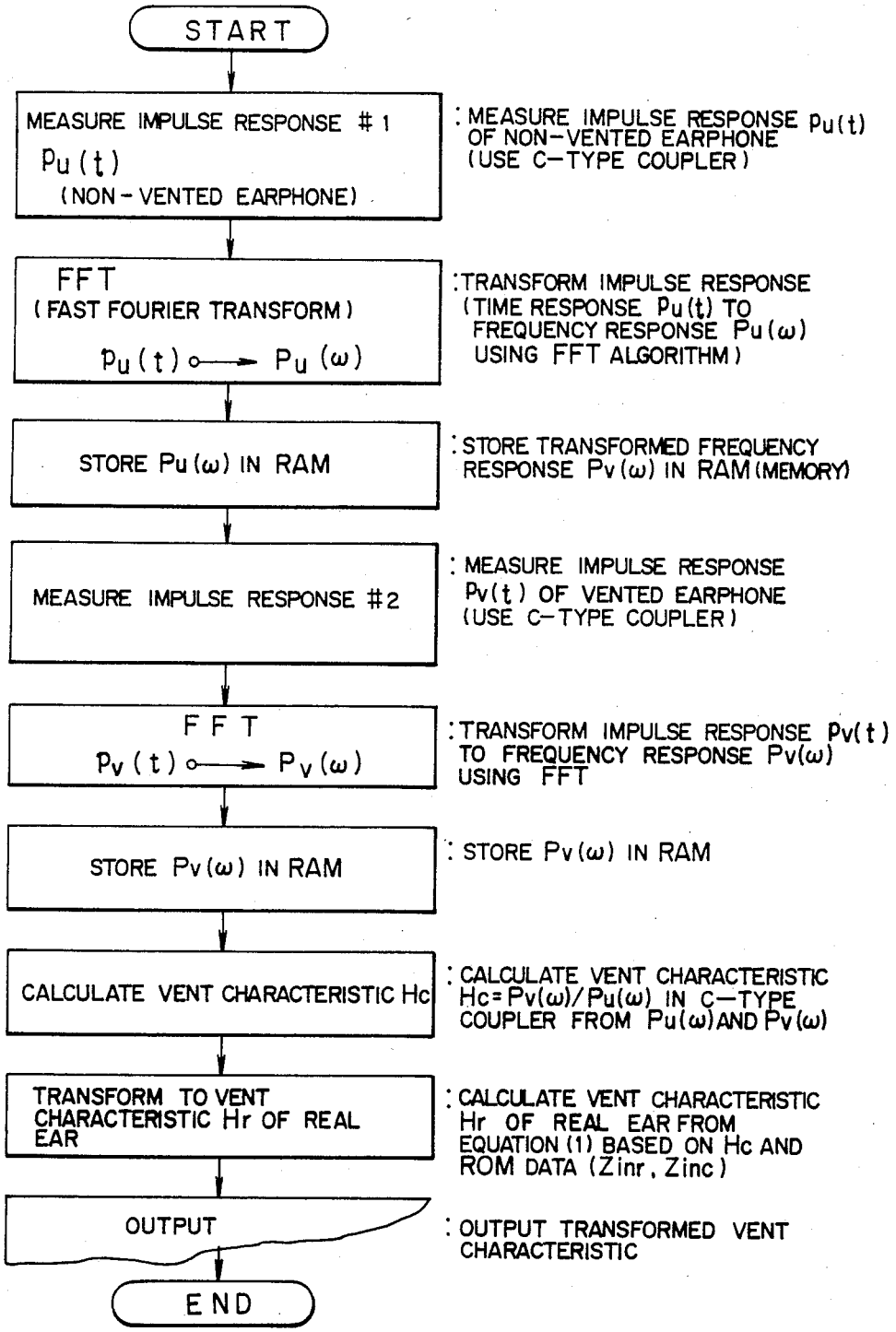
FIG. 5 is a flow chart for explaining an operation of the embodiment.

FIG. 5 shows measuring steps when the vent characteristic is measured by the embodiment of FIGS. 4*a* and 4*b*, and FIG. 6 shows a measurement result. In FIG. 6, B shows an example of the vent characteristic of the real ear, and C shows the vent characteristic (before transform) of the output of the microphone 2 of the artificial ear shown in FIG. 4*b*. Since the characteristic of the artificial ear of FIG. 4*b* is different from that of the 2 cc coupler shown in FIG. 1*a*, the resulting vent characteristic is also different from the curve a shown in FIG. 2. In FIG. 6, A shows the vent characteristic measured by the embodiment of FIGS. 4*a* and 4*b* using the same vented earphone. The resulting vent characteristic is essentially identical with that of the real ear.

Figure 7:
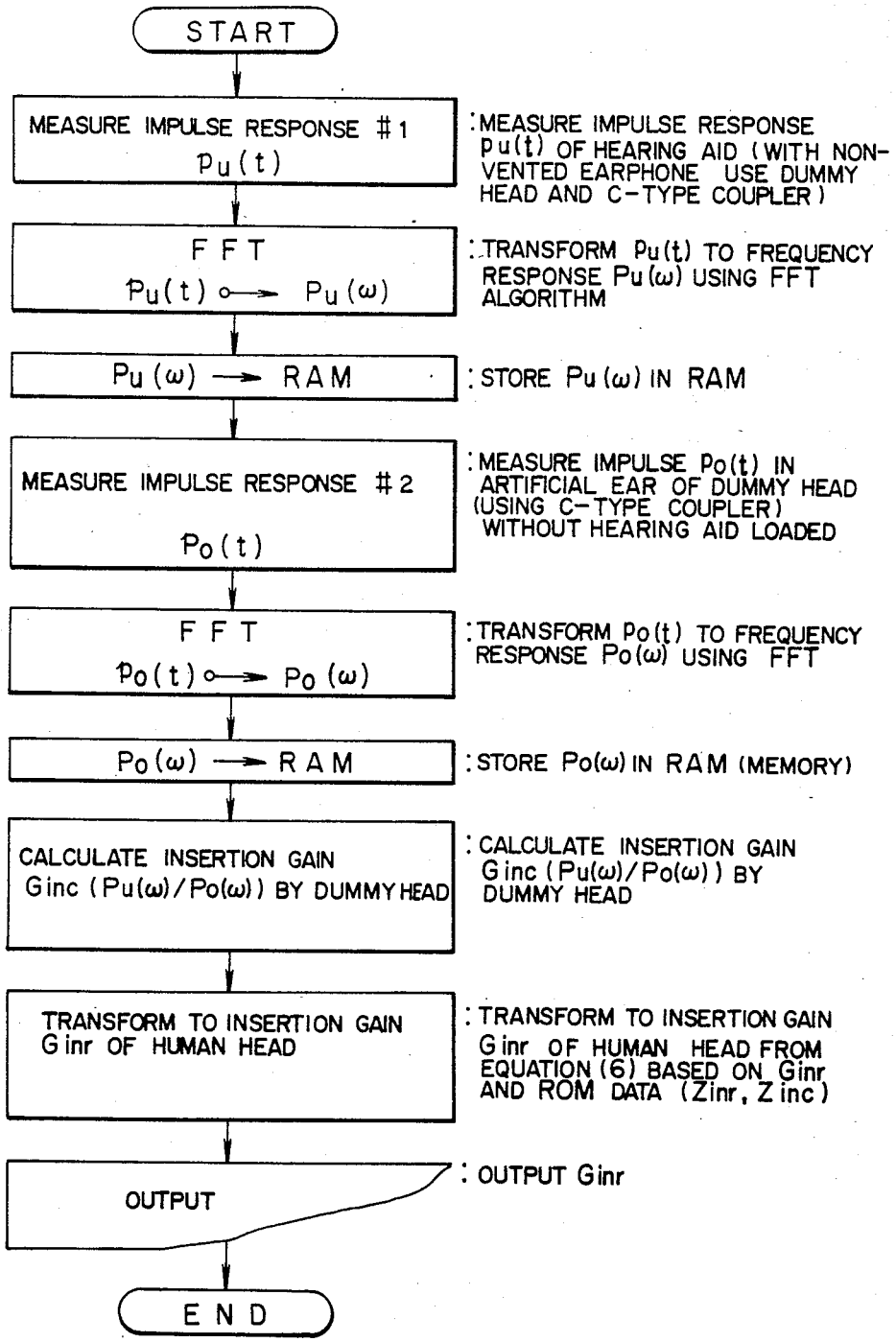
FIGS. 7, 8*a* and 8*b* are flow charts for explaining measurement methods in other embodiments of the present invention.

FIG. 7 shows measurement steps for a hearing aid insertion gain measured by the embodiment of FIG. 4*a*. The insertion gain is represented by a ratio of a sound pressure in the external auditory canal when the hearing aid is not inserted to the real ear and a sound pressure in the external auditory canal when the hearing aid is inserted in the real ear. A principle of measurement is now explained. The sound pressure $P_U$ in the coupler when the hearing aid is loaded is represented as follows, from the equation (1).

$$P_U = Z_{inc} \cdot U \tag{4}$$

The sound pressure $P_U$ in the external auditory canal when the hearing aid is loaded is represented as follows, from the equation (2).

$$\hat{P}_U = Z_{inr} \cdot U \tag{5}$$

For the dummy head with the coupler of FIG. 4*b*, $P_o \approx \hat{P}_o$ is met, where $P_o$ is the sound pressure in the coupler when the hearing aid is not loaded to the dummy head, and $\hat{P}_o$ is the sound pressure in the external auditory canal when the hearing aid is not loaded to the real ear. From the equations (4) and (5), the insertion gain $G_{inr}$ when the hearing aid is loaded to the real ear is expressed as follows.

$$G_{inr} = \frac{\hat{P}_U}{\hat{P}_o} = \frac{\hat{P}_U}{P_o} = \frac{P_U \cdot \frac{Z_{inr}}{Z_{inc}}}{P_o} = \frac{P_U}{P_o} \cdot \frac{Z_{inr}}{Z_{inc}} = G_{inc} \cdot \frac{Z_{inr}}{Z_{inc}} \tag{6}$$

Thus, by correcting the hearing aid insertion gain $G_{inc}$ ($P_U/P_o$) measured by the dummy head by the factor of $Z_{inr}/Z_{inc}$, the insertion gain $G_{inr}$ in the real ear can be obtained.

The correction calculation of the equation (6) is carried out by the measurement instrument 100 shown in FIG. 4*a*.

Figure 8A:
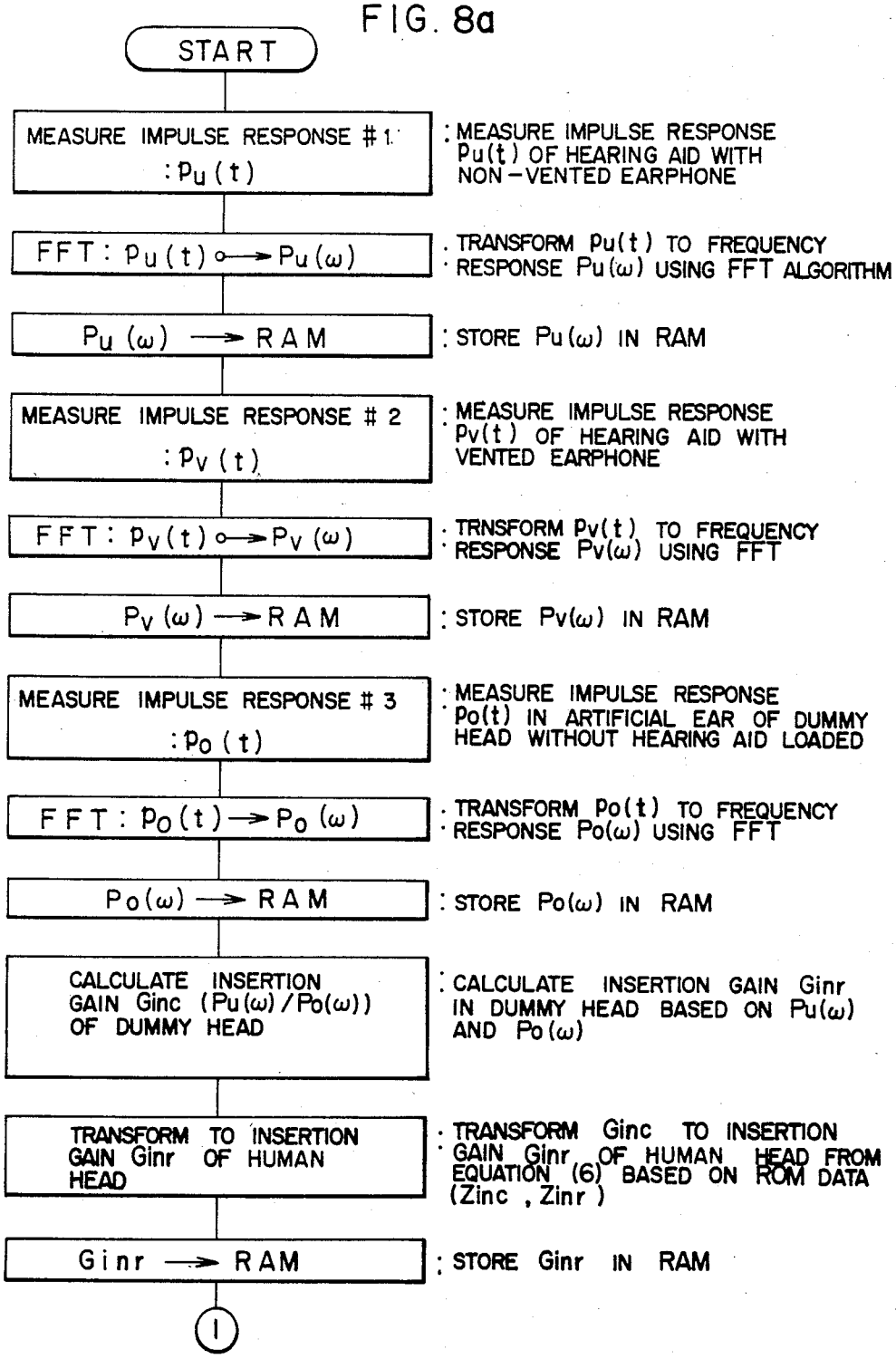
Figure 8B:
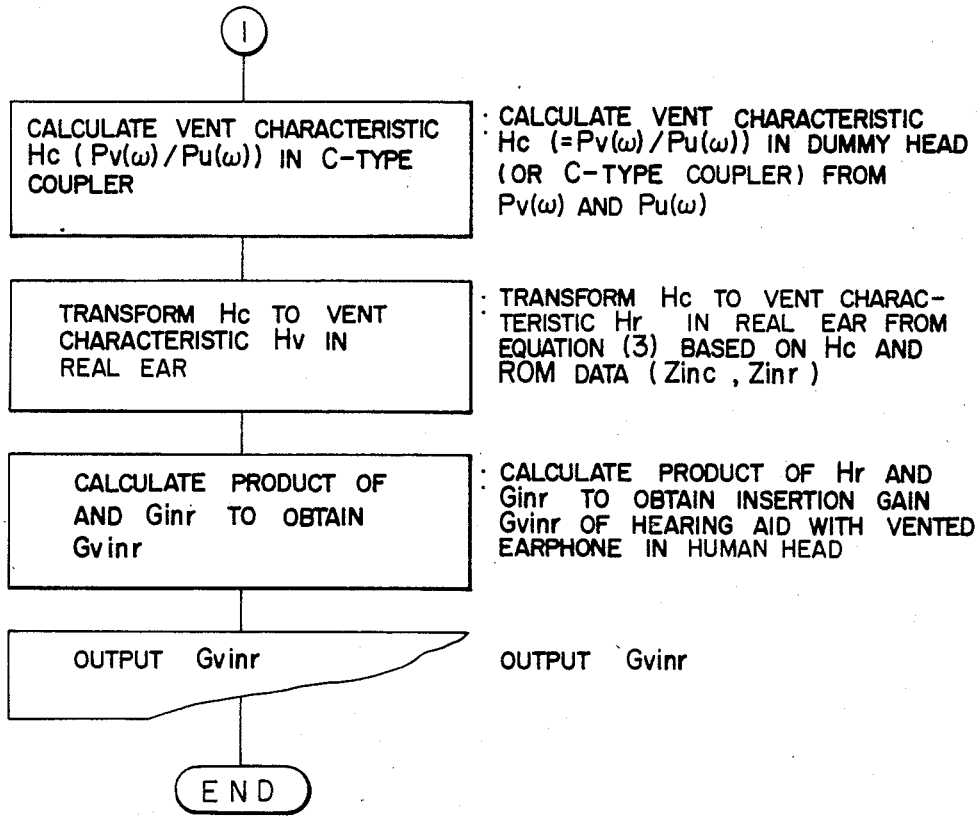

FIG. 8 shows steps for measuring the hearing aid insertion gain with the vented earphone by the embodiment of FIG. 4*a*. The vent characteristic and the insertion gain are sequentially measured. The insertion gain $Gv_{inr}$ in the real ear is given by $$Gv_{inr} = \frac{\hat{P}_v}{\hat{P}_o} = \frac{\hat{P}_u}{\hat{P}_o} \cdot \frac{\hat{P}_v}{\hat{P}_u} \tag{7}$$

where $\hat{P}_v$ is the sound pressure in the external auditory canal of the real ear when the hearing aid with the vented earphone is loaded, $\hat{P}_u/\hat{P}_o$ is the insertion gain $G_{inr}$ in the real ear for the hearing aid with the non-vented earphone, and $\hat{P}_v/\hat{P}_u$ is the vent characteristic $H_r$ of the real ear. Accordingly, the insertion gain $Gv_{inr}$ when the hearing aid with the vented earphone is loaded in the real ear is represented by $$Gv_{inr} = G_{inr} \cdot H_r \tag{8}$$

Accordingly, $Gv_{inr}$ is obtained by calculating the equations (6) and (3) sequentially and calculating the product thereof (equation (8)). These calculations are carried out by the measurement instrument 100 of FIG. 4*a*.

Figure 1B:
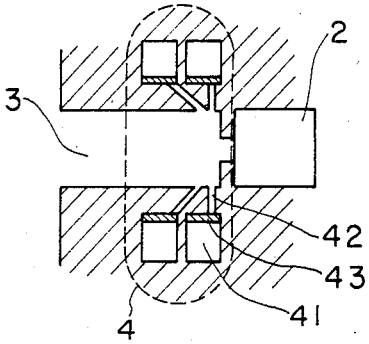
FIG. 1b PRIOR ART

By determining the vent characteristic by combining a data of a particular individual with the input impedance $Z_{inr}$ of the real ear, the calculation of the hearing aid based on a variation among individuals, which has not been attained in the prior art device of FIG. 1*b*, can be achieved.

When an earphone other than hearing aids is to be measured an output of the impulse generator 107 may be coupled directly to an input terminal of the earphone.

We claim:

1. An earphone characteristic measuring device for simulation-measuring a characteristic of an earphone in a real ear, comprising:

an acoustic coupler including an acoustic tube having an opening to which an earphone under measurement is to be removably mounted and having an acoustic resistance termination;

sound source means for generating sound information to said acoustic coupler;

pickup means coupled to an end of said acoustic coupler to pick up sound pressure information in said acoustic coupler:

memory means for storing an input impedance $Z_{inc}$ of said acoustic coupler viewed from an end of an earmold of said earphone inserted into said acoustic coupler, an input impedance $Z_{inr}$ of the real ear represented by a sum of an eardrum impedance of the real ear and an external auditory canal volume of the real ear, and the sound pressure information in said acoustic coupler supplied from said pickup means;

characteristic calculation means coupled to said memory means for transforming the earphone characteristic of the acoustic coupler to the earphone characteristic of the real ear; and output means coupled to said characteristic calculation means for outputting a calculation result.

2. An earphone characteristic measuring device according to claim 1, wherein said memory means stores a program for calculating by said characteristic calculation means a vent characteristic $H_r$ of a vented earphone in the real ear;

$$H_r = \frac{Z_{inc} \cdot H_c}{Z_{inc} \cdot H_c + (1 - H_c) \cdot Z_{inr}}$$

where $H_c$ is a vent characteristic measured by said acoustic coupler.

3. An earphone characteristic measuring device according to claim 1, wherein said memory means stores a program for calculating by said characteristic calculation means an insertion gain $G_{inr}$ in the real ear;

$$G_{inr} = G_{inc} \cdot \frac{Z_{inr}}{Z_{inc}}$$

where $G_{inc}$ is an insertion gain measured by said acoustic coupler mounted in a dummy head.

4. An earphone characteristic measuring device according to claim 1, wherein said acoustic coupler is mounted in a dummy head simulated to a human head through a pinna formed on an outer periphery of said dummy head.

5. An earphone characteristic measuring device according to claim 4, wherein said dummy head is mounted on a dummy body simulated to a human body.

6. An earphone characteristic measuring device according to claim 1, wherein said sound source means includes an electrical impulse generating circuit having an impulse period irregularly changed in a predetermined pattern, and impulse response thereto being averaged in said memory means.

7. An earphone characteristic measuring device according to claim 1, wherein said acoustic coupler comprises a further acoustic tube of a smaller diameter than said acoustic tube of said acoustic coupler, said further acoustic tube being connected to an end of said acoustic tube and having an acoustic impedance of approximately 320 ohms.

8. An earphone characteristic measuring device according to claim 2, wherein said acoustic coupler is mounted in a dummy head simulated to a human head through a pinna formed on an outer periphery of said dummy head.

9. An earphone characteristic measuring device according to claim 8, wherein said dummy head is mounted on a dummy body simulated to a human body.

10. An earphone characteristic measuring device according to claim 2, wherein said sound source means includes an electrical impulse generating circuit having an impulse period irregularly changed in a predetermined pattern, and impulse responses thereto being averaged in said memory means.

11. An earphone characteristic measuring device according to claim 2, wherein said acoustic coupler comprises a further acoustic tube of a smaller diameter than said acoustic tube of said acoustic coupler, said further acoustic tube being connected to an end of said acoustic tube and having an acoustic impedance of approximately 320 ohms.

12. An earphone characteristic measuring device according to claim 3, wherein said acoustic coupler is mounted in a dummy head simulated to a human head through a pinna formed on an outer periphery of said dummy head.

13. An earphone characteristic measuring device according to claim 12, wherein said dummy head is mounted on a dummy body simulated to a human body.

14. An earphone characteristic measuring device according to claim 3, wherein said sound source means includes an electrical impulse generating circuit having an impulse period irregularly changed in a predetermined pattern, and impulse responses thereto being averaged in said memory means.

15. An earphone characteristic measuring device according to claim 3, wherein said acoustic coupler comprises a further acoustic tube of a smaller diameter than said acoustic tube of said acoustic coupler, said further acoustic tube being connected to an end of said acoustic tube and having an acoustic impedance of approximately 320 ohms.

16. An earphone characteristic measuring method for simulation-determining an insertion gain characteristic of an earphone in a real ear, comprising the steps of:

placing an earphone under measurements into an acoustic coupler including an acoustic tube having an opening to which the earphone is to be removably mounted and having an acoustic resistance termination;

generating sound information to the acoustic coupler;

coupling a pickup to an end of the acoustic coupler for picking up sound pressure information in the acoustic coupler;

storing an input impedance $Z_{inc}$ of the acoustic coupler viewed from an end of an earmold of the earphone inserted into the acoustic coupler, an input impedance $Z_{inr}$ of the real ear represented by a sum of an eardrum impedance of the real ear and an external auditory canal volume of the real ear, and the sound pressure information in said acoustic coupler supplied from the pickup;

storing a program for calculating an insertion gain $G_{inr}$ in the real ear;

$$G_{inr} = G_{inc} \cdot \frac{Z_{inr}}{Z_{inc}}$$

where $G_{inc}$ is an insertion gain measured by the acoustic coupler mounted in a dummy head; and calculating the earphone insertion gain in the real ear from the stored input impedance $Z_{inc}$ of the acoustic coupler, input impedance $Z_{inr}$ of the real ear and sound pressure information in accordance with the stored program for calculation of the insertion gain.

17. A method for simulation-determining a vent characteristic of an earphone in a real ear, comprising the steps of:

placing an earphone under measurement into an acoustic coupler including an acoustic tube having an opening to which the earphone is to be removably mounted and having an acoustic resistance termination;

generating sound information to the acoustic coupler;

coupling a pickup to an end of the acoustic coupler for picking up sound pressure information in the acoustic coupler;

storing an input impedance $Z_{inc}$ of the acoustic coupler viewed from an end of an earmold of said earphone inserted into the acoustic coupler, an input impedance $Z_{inr}$ of the real ear representing a sum of an eardrum impedance of the real ear and an external auditory canal volume of the real ear, and the sound pressure information in the acoustic coupler supplied from the pickup;

storing a program for calculating a vent characteristic $H_r$ of a vented earphone in the real ear;

$$H_r = \frac{Z_{inc} \cdot H_c}{Z_{inc} \cdot H_c + (1 - H_c) \cdot Z_{inr}}$$

where $H_c$ is a vent characteristic measured by the acoustic coupler; and calculating the vent characteristic $H_r$ from the stored input impedance $Z_{inc}$ of the acoustic coupler, input impedance $Z_{inr}$ of the real ear, and sound pressure information in accordance with the stored program for calculation of the vent characteristic.

* * * * *